United States Patent [19]

Fusi

[11] 4,181,334

[45] Jan. 1, 1980

[54] SAFETY CATCH

[75] Inventor: Angelo Fusi, Turin, Italy

[73] Assignee: Fiat Societa per Azioni, Turin, Italy

[21] Appl. No.: 868,150

[22] Filed: Jan. 9, 1978

[30] Foreign Application Priority Data

Jan. 18, 1977 [IT] Italy ..... 67101 A/77

[51] Int. Cl.[2] ..... E05C 19/06

[52] U.S. Cl. ..... 292/87; 292/262; 292/DIG. 14

[58] Field of Search ..... 292/81, 80, 91, 86, 292/87, 262, 272, 274, 275, 278, DIG. 14, DIG. 44, 82–85, 88–90; 16/63, 78, 85; 70/93

[56] References Cited

U.S. PATENT DOCUMENTS

| | | | |
|---|---|---|---|
| 654,723 | 7/1900 | Franks | 292/262 |
| 1,415,122 | 5/1922 | Schofield | 292/DIG. 14 X |
| 1,482,494 | 2/1924 | Weiss | 292/DIG. 14 X |
| 1,579,360 | 4/1926 | Hartwig | 292/80 X |
| 1,661,891 | 3/1928 | Gilmore | 292/DIG. 14 X |
| 2,550,203 | 4/1951 | Robinson | 292/DIG. 14 X |
| 3,934,907 | 1/1976 | McGillivray | 292/80 X |

*Primary Examiner*—Roy D. Frazier
*Assistant Examiner*—William E. Lyddane
*Attorney, Agent, or Firm*—Sughrue, Rothwell, Mion, Zinn and Macpeak

[57] ABSTRACT

A safety catch for a frontally opening hood of a motor vehicle comprises a resilient strip having transverse tongues at its upper end which snap engage in a recess in a bracket on the under side of the hood, the strip being capable of limited vertical movement and being anchored elastically at its lower end. Snap engagement of the tongues in the recess is facilitated by curvature of the upper end of the strip in the longitudinal direction of the vehicle, and release of the catch is effected by exerting finger pressure on the resiliently flexible strip to disengage it from the recess.

4 Claims, 3 Drawing Figures

38
18
18
34
34a
16
D
20
22
24
29
30
26
28

SAFETY CATCH

BACKGROUND OF THE INVENTION

The present invention relates to a safety catch for a hinged hood of the type which opens at the front of a vehicle engine compartment. The invention concerns more particularly a safety catch of the type which is fitted to the front sill of the engine compartment for engagement in a seat provided at the front of the hood, to prevent opening of the hood under the action of the slipstream.

Known safety catches of this type in general have parts which project from the engine compartment sill and/or the hood and which can cause injury to a person working under the hood, for example during inspection or repair work.

This invention has the object of providing a catch made up of simple and easily assembled parts which are unlikely to cause injury to persons requiring access to the engine compartment, for example for inspection or repairs.

SUMMARY OF THE INVENTION

According to the present invention there is provided a safety catch for a frontally opening hood of a motor vehicle engine compartment, of the type adapted to be fitted to a front sill of the engine compartment for engagement in a seat provided at the front of the hood, wherein the catch comprises a resilient strip which is movable vertically and which has an upper end portion provided with transverse tongues adapted to fit by snap-engagement in a recess provided in a bracket attached to the lower surface of the hood, the lower end of the strip being anchored elastically.

The safety catch of this invention has the practical advantage that it presents no dangerous hooks or obstructions on the inside of the hood or on the front sill of the engine compartment, the resilient strip of the safety catch being flexible and free of hooks or sharp edges.

Preferably the intermediate portion of the strip is guided longitudinally in a support which is fixed to the front sill of the engine compartment.

According to a preferred feature of the invention the intermediate portion of the strip between the support and its elastic anchorage carries a stop block adapted to strike against a lower surface of the support in order to restrict upward movement of the strip.

When disengaged manually from the recess the strip is retracted by its elastic anchorage, allowing the hood to be opened freely.

BRIEF DESCRIPTION OF THE DRAWINGS

The invention will be further described, by way of non-limiting example, with reference to the accompanying drawings, in which.

DESCRIPTION OF THE ILLUSTRATED EMBODIMENT

Figure 1:
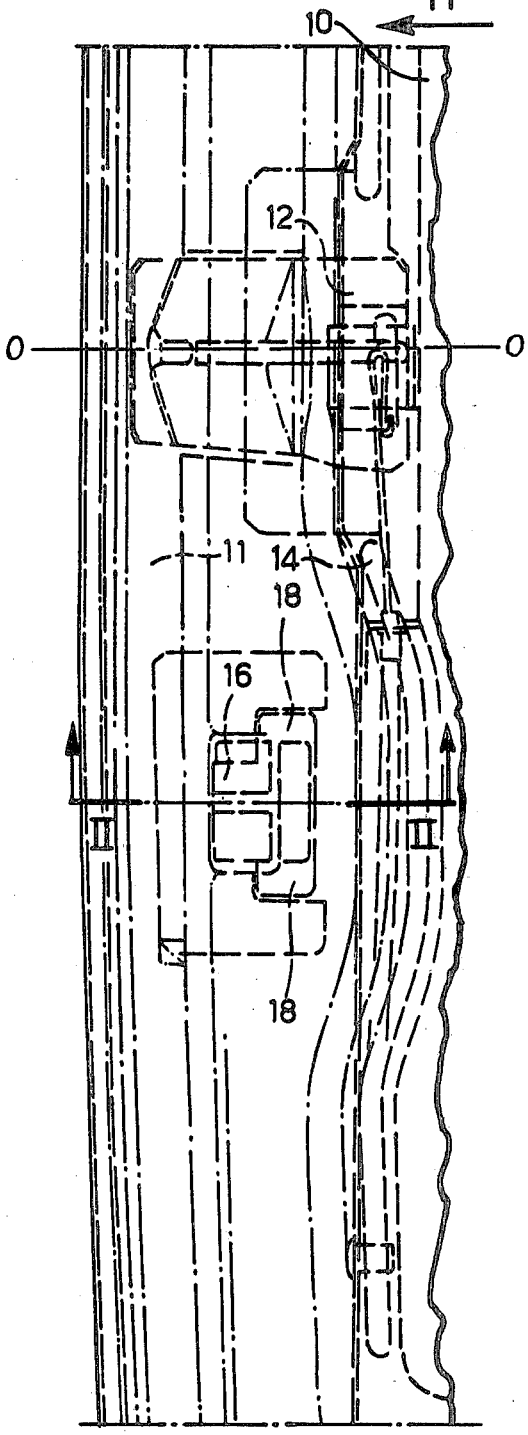
FIG. 1 is a plan view from above, partially in section, of the front part of a hood of a motor vehicle provided with a safety catch according to the invention.

In the drawings, FIG. 1 shows the front part of a hinged hood 10 designed to close a front engine compartment of a motor vehicle. The direction of travel of the vehicle is indicated by the arrow M, the hood 10 being of the type opening at the front, upwind of the hinged end of the hood, so that the slipstream when the vehicle is moving forwards in the direction of arrow M exerts a lifting action on the hood.

In correspondence with the longitudinal axis 0—0 of the motor vehicle, there is fitted to the front edge of the hood 10 and to the front sill 11 of the engine compartment a lock 12 which can be operated by a flexible cable 14.

On the left-hand side of the lock, viewed in the direction of the arrow M, on the front sill 11 of the engine compartment there is fitted a safety catch comprising a resiliently flexible strip 16 having a rearwardly curved arcuate upper end portion, curved in a longitudinal plane of the vehicle and convex towards the front, which projects upwardly beyond the front sill 11 of the engine compartment and which has at its upper end two laterally projecting transverse tongues 18. The strip 16 is movable vertically and slides in a guide slot 20 in a support 22 fixed to a part of the front sill 11 of the engine compartment. The cross-section of the guide slot 20 corresponds to the cross-section of the strip 16 which has, in an intermediate portion, a central longitudinal raised rib 24.

Hooked to the lower end of the strip 16 is a helical tension spring 26 which is anchored at its lower end to a bracket 28 fixed to the motor vehicle body or chassis. To the lower portion 24 of the strip 16 which is between the support 22 and the spring 26 there is affixed, by means of a clamping screw 29, a stroke-limiting stop block 30 which strikes against the lower end of the support block 22 in order to limit the upward travel of the strip 16 when the latter reaches the upper position shown in dashed outline in FIG. 2.

A sheet metal bracket 32 is attached to the inner (lower) surface of the hood 10, opposite the sill 11. The bracket 32 is provided with a generally rectangular aperture 34, so dimensioned that the curved upper end portion of the strip 16 with its two lateral tongues 18 is able to pass through it. A front part of the bracket 32 adjacent the aperture 34 is reinforced by means of a plate 36 affixed to the upper surface of the bracket 32 and provided with a recess 38 which coincides with a notch **34*a* in the front edge of the aperture 34 in the underlying bracket 32. The width of the recess 38 and the said notch 34*a* corresponds with that of the part of the strip 16 immediately below the tongues 18. The upper part of the strip 16 is urged forwardly by the elasticity of the strip so that the tongues 18 are resiliently engaged in the recess 38 when the hood 10** is closed, as shown by full lines in FIG. 2.

Figure 2:
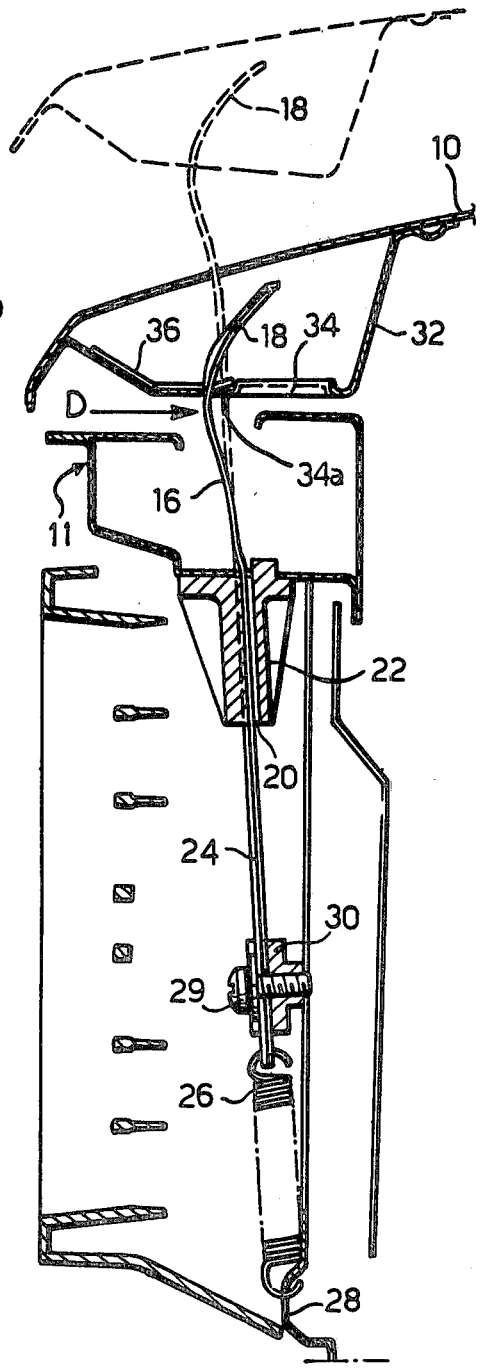
FIG. 2 is a longitudinal section, on an enlarged scale, taken along the line II—II of FIG. 1.

If, while the vehicle is travelling forwards in the direction of arrow M, the lock 12 of the hood 10 should open accidentally, then the hood 10 can open under the action of the slipstream only as far as the position illustrated by the dashed lines in FIG. 2: this partially open position corresponds to the upper limit position of the stop block 30 at which the latter strikes against the lower end of the support 22.

Figure 3:
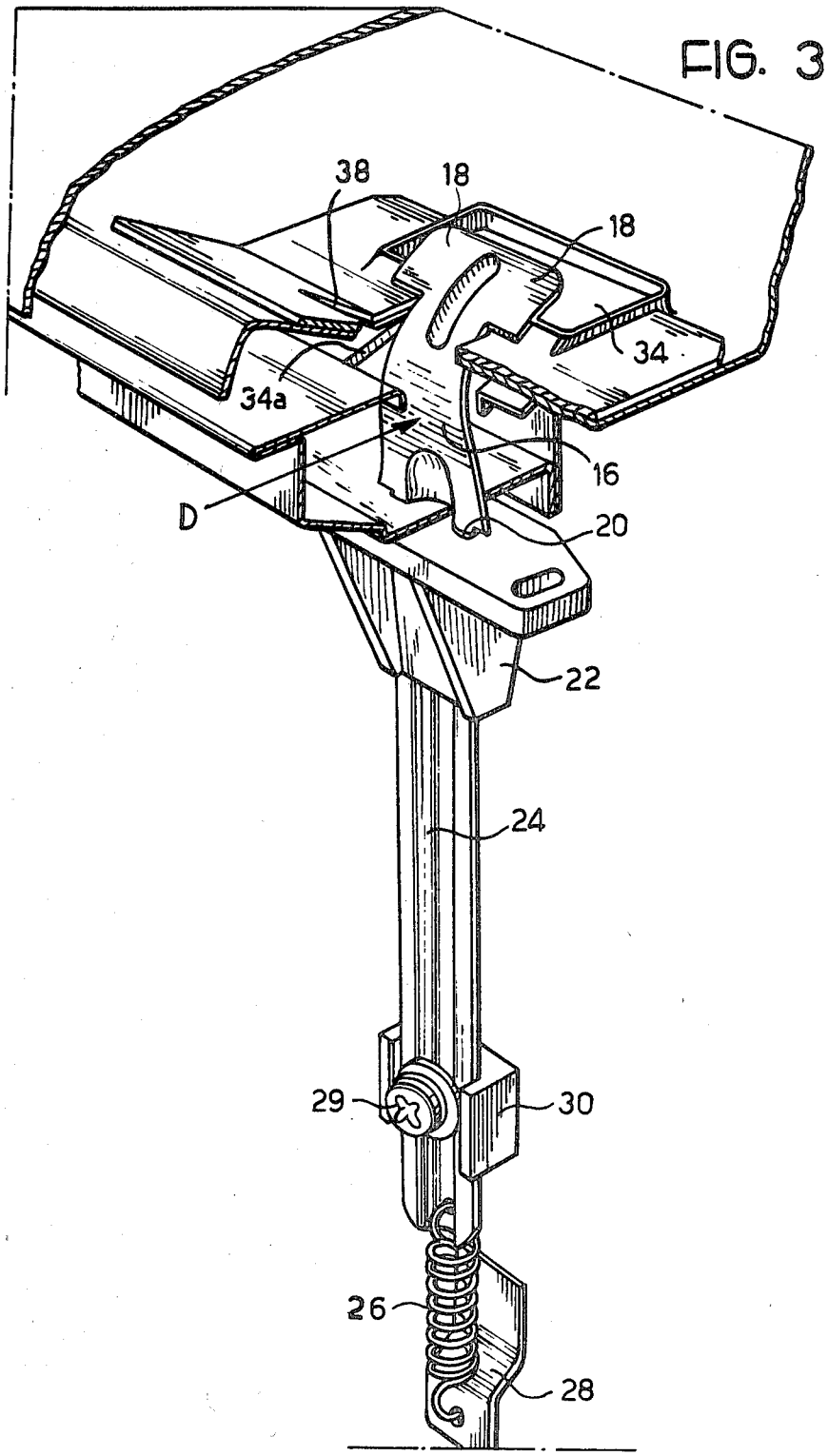
FIG. 3 is a perspective view of the catch and part of the hood, shown partly cut away.

Lifting of the hood 10 to gain access to the engine compartment is effected in a manner known per se: after releasing the lock 12, the hood 10 will be pushed up for a short distance under the action of a resilient element which may be a spring of a traditional type, not illustrated, which is compressed when the hood is fully closed. In this partly open position of the hood 10 a finger or fingers may be inserted between the front edge of the hood 10 and the sill to exert rearward pressure on the strip 16 in the direction of the arrow D, (FIG. 3), pushing the curved upper portion of the strip 16 rearwardly to release the strip from the recess 38 and to displace the tongues 18 into the aperture 34. Single finger pressure will suffice to release the strip 16 in this way, whereupon the tongues 18 can pass freely through the aperture 34 and the hood 10 can then be lifted further into the fully open position.

Upon closure of the hood 10 the two tongues 18 of the strip 16 snap-engage into the recess 38 after the tongues 18 have passed upwardly through the aperture 34. This engagement is facilitated by the arcuate shape of the upper end portion of the strip 16.

What is claimed is:

1. A safety catch for a frontally opening hood of a motor vehicle engine compartment comprising catch means adapted to be fitted to a front sill of the engine compartment, complimentary seat means adapted to be secured at the front of the hood, said catch means comprising an elongated flexible resilient strip, support means guiding said strip for vertical movement, said strip having a curved upper end portion provided with two transverse tongues, said seat means comprising a bracket adapted to be fitted to the lower surface of the hood, said bracket having an aperture for receiving the curved end portion having the tongues thereon and a recess in one edge of said aperture into which said strip will be biased by the resiliency of the strip after the tongues pass through said aperture, and elastic anchoring means for the lower end of the strip.

2. A safety catch as set forth in claim 1, wherein the elastic anchoring means comprises a tension spring secured at one end to the lower end of said strip and adapted to be secured at the opposite end to a motor vehicle.

3. A safety catch as set forth in claim 1, further comprising a stop block adjustably secured to said strip and adapted to strike against the lower surface of said support means in order to restrict upward movement of said strip.

4. A safety catch as set forth in claim 1, wherein said recess is located in communication with the front edge of said aperture and said strip is resiliently flexible in the longitudinal direction of the motor vehicle so as to be disengageable from said recess upon being pushed toward the rear of the motor vehicle.

* * * * *